US005169072A

United States Patent [19]

Gulyas

[11] Patent Number: 5,169,072

[45] Date of Patent: Dec. 8, 1992

[54] SHOWER HEAD APPARATUS

[76] Inventor: Attila Gulyas, 35 Woodbridge Cr. #402, Nepean, Ontario, Canada, K2B 7T5

[21] Appl. No.: 729,176

[22] Filed: Jul. 12, 1991

[51] Int. Cl.[5] ..... B05B 3/04; B05B 1/08

[52] U.S. Cl. ..... 239/381; 239/240; 239/101

[58] Field of Search ..... 239/380, 381, 530, 240, 239/382, 525, 237, 101

[56] References Cited

U.S. PATENT DOCUMENTS

| | | | |
|---|---|---|---|
| 3,801,019 | 4/1974 | Trenary et al. | 239/381 |
| 3,963,179 | 6/1976 | Tomaro | 239/101 |
| 4,068,801 | 1/1978 | Leutheuser | 239/381 |
| 4,079,891 | 3/1978 | Kwan | 239/381 |
| 4,081,135 | 3/1978 | Tomaro | 239/381 |
| 4,101,075 | 7/1978 | Heitzman | 239/101 |
| 4,141,502 | 2/1979 | Grohe | 239/381 |
| 4,151,957 | 5/1979 | Gecewicz et al. | 239/530 |
| 4,588,130 | 5/1986 | Trenary et al. | 239/381 |
| 4,801,091 | 1/1989 | Sandvik | 239/381 |
| 4,930,699 | 6/1990 | Wall | 239/381 |

*Primary Examiner*—Andres Kashnikow
*Assistant Examiner*—Chrisotpher G. Trainor
*Attorney, Agent, or Firm*—Leon Gilden

[57] ABSTRACT

An apparatus wherein a central support wand mounts a shower head thereon, with the shower head including a first conduit directing a first stream of water from a first source at an annular array from the head, with a central housing in the head rotatably mounted to direct and disperse a spray therefrom in a continuous and pulsating stream arrangement.

3 Claims, 5 Drawing Sheets

SHOWER HEAD APPARATUS

BACKGROUND OF THE INVENTION

1. Field of the Invention

The field of invention relates to shower heads, and more particularly pertains to a new and improved shower head apparatus wherein the same is directed to providing various spray to an individual.

2. Description of the Prior Art

Shower heads of various types are utilized in the prior art, particularly of a massaging type arrangement. Such a shower head is exemplified in U.S. Pat. No. 4,709,691 to Lemons utilizing an eccentric weight rotor mounted within the head to direct spray from the head.

U.S. Pat. No. 4,640,462 to Stearns, III wherein a water driven shower massager is utilized by utilizing an eccentrically weighted water discharge nozzle to direct an oscillating vibrational motion applied from the shower head.

U.S. Pat. No. 4,629,125 to Liu sets forth a spray nozzle to direct a pulsating spray utilizing three separate groups of discharge orifices to direct flow through three sets of passages to discharge the plurality of sprays.

U.S. Pat. No. 4,100,917 to Talge, et al. sets forth a hydrotherapy unit arranged for mounting within a bathtub to direct spray therefrom in a vibratory and oscillating manner.

U.S. Pat. No. 4,508,665 to Spinnett sets forth a pulsating arrangement arranged for retrofit to mix air and water in a therapy tub or spa and the like.

As such, it may be appreciated that there continues to be a need for a new and improved shower head apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shower head apparatus now present in the prior art, the present invention provides a shower head apparatus wherein the same is arranged for directing pulsating spray in a massaging procedure in a shower head arrangement. As such, the general purpose of the present invention, which will be described subsequently in greater detail, is to provide a new and improved shower head apparatus which has all the advantages of the prior art shower head apparatus and none of the disadvantages.

To attain this, the present invention provides an apparatus wherein a central support wand mounts a shower head thereon, with the shower head including a first conduit directing a first stream of water from a first source at an annular array from the head, with a central housing in the head rotatably mounted to direct and disperse a spray therefrom in a continuous and pulsating stream arrangement.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shower head apparatus which has all the advantages of the prior art shower head apparatus and none of the disadvantages.

It is another object of the present invention to provide a new and improved shower head apparatus which may be easily and efficiently manufactured and marketed.

It is a further object of the present invention to provide a new and improved shower head apparatus which is of a durable and reliable construction.

An even further object of the present invention is to provide a new and improved shower head apparatus which is susceptible of a low cost of manufacture with regard to both materials and labor, and which accordingly is then susceptible of low prices of sale to the consuming public, thereby making such shower head apparatus economically available to the buying public.

Still yet another object of the present invention is to provide a new and improved shower head apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric exploded illustration of the invention.

FIG. 10 is an orthographic cross-sectional illustration of the impeller housing utilizing a modified blade assembly.

DESCRIPTION OF THE PREFERRED EMBODIMENT

Figure 1:
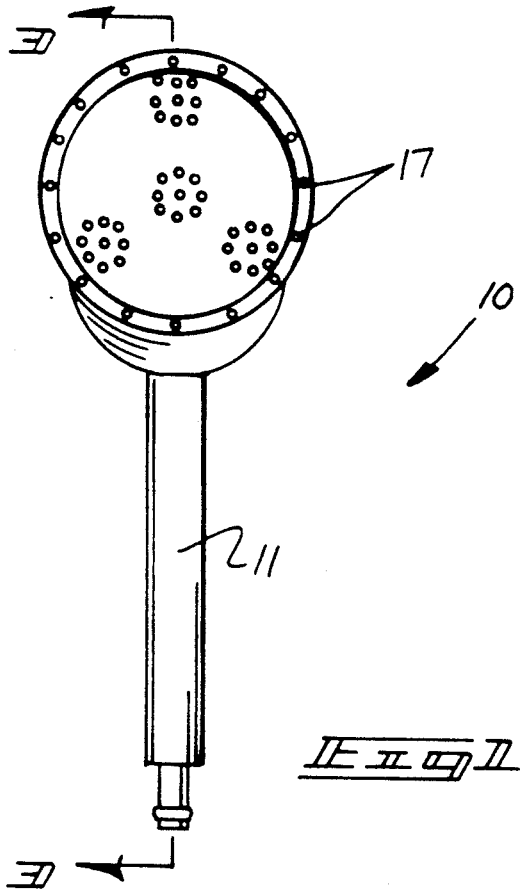
FIG. 1 is an orthographic top view of the instant invention.
Figure 2:
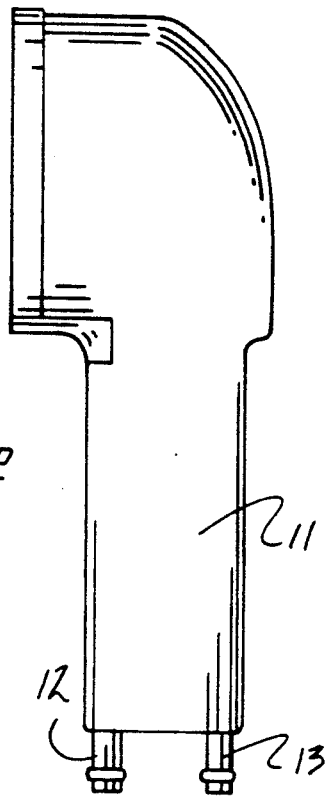
FIG. 2 is an orthographic side view of the instant invention.

With reference now to the drawings, and in particular to FIGS. 1 to 11 thereof, a new and improved shower head apparatus embodying the principles and concepts of the present invention and generally designated by the reference numeral 10 will be described.

Figure 3:
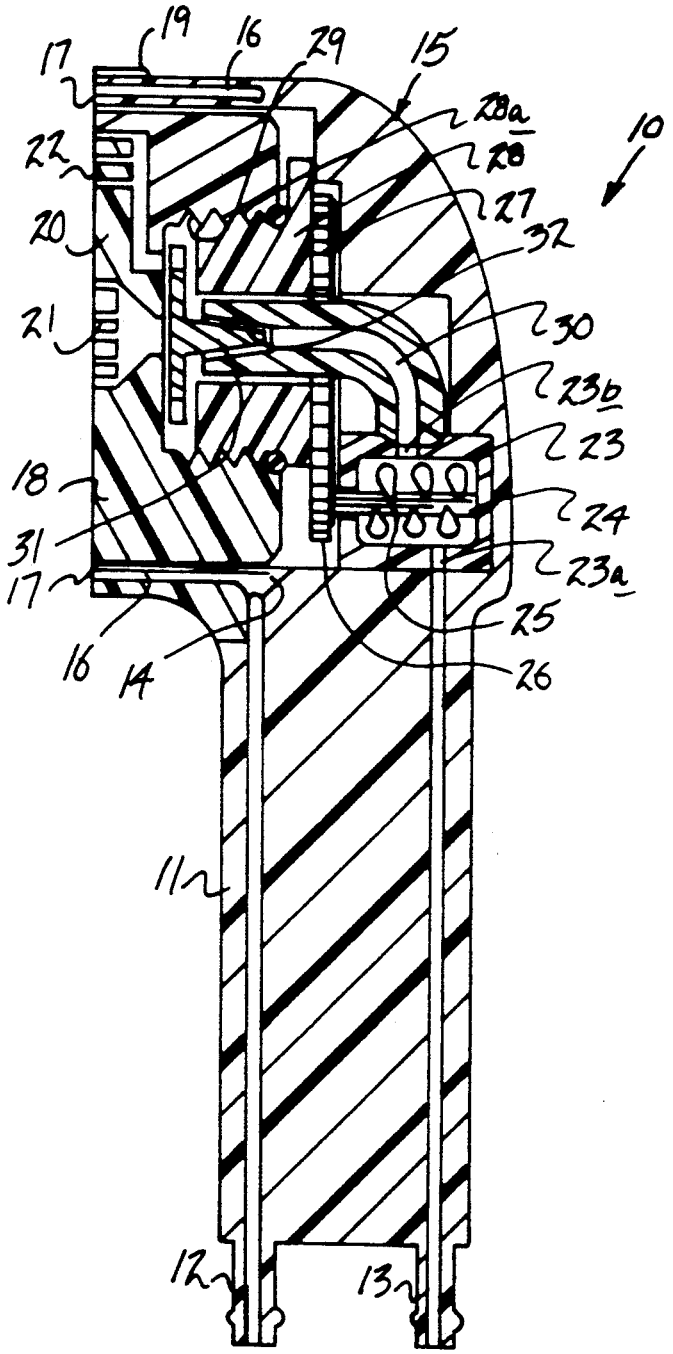
FIG. 3 is an orthographic cross-sectional illustration of the invention.

More specifically, the shower head apparatus 10 of the instant invention essentially comprises a rigid conduit wand 11 that includes respective first and second fluid conduits 12 and 13 directed therethrough, with the first fluid conduit 12 directing heated water therethrough, with the second conduit 13 directing unheated water therethrough. The water through the first fluid conduit 12 is directed through a first annular conduit 14 (see FIG. 3) that is directed in an annular manner about the spray head 15 that is orthogonally oriented relative to the wand 11. The first annular conduit 14 (see FIG. 7) is directed in a cylindrical manner about a peripheral portion of the head 15 and in communication with a cylindrical outer channel 16 that directs a continuous heated water spray through an annular array of first outlet ports 17 (see FIGS. 1, 3, and 7). The spray head 15 includes a generally planar spray head face 18, wherein the direction of fluid from the spray head 15 is orthogonally oriented relative to the planar face 18. The outer cap housing 19 includes the annular array of outlet ports 17 to secure the outer cap housing 19 relative to the head 15, in a manner as illustrated in FIGS. 3 and 7.

A central cap housing 20 is rotatably mounted within the spray head 15 and includes a central cap axial opening array of openings 21 (see FIG. 7) to direct a pulse of spray coaxially of the head 15. A plurality of outer opening groups 22 defining an annular array concentrically of and interiorly of the first outlet ports 17 are positioned in an annular array about the axial openings 21.

Figure 4:
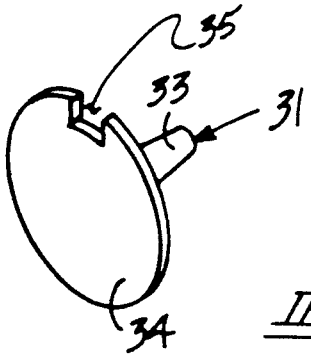
FIGS. 4, 5, and 6 are isometric illustrations of various deflector hubs mounted within the shower head for directing a pulsating spray medially of the shower head of the invention.
Figure 5:
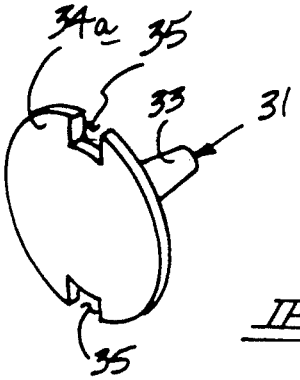
Figure 6:
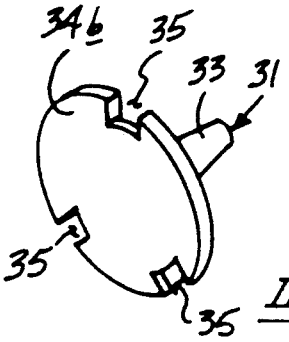
Figure 11:
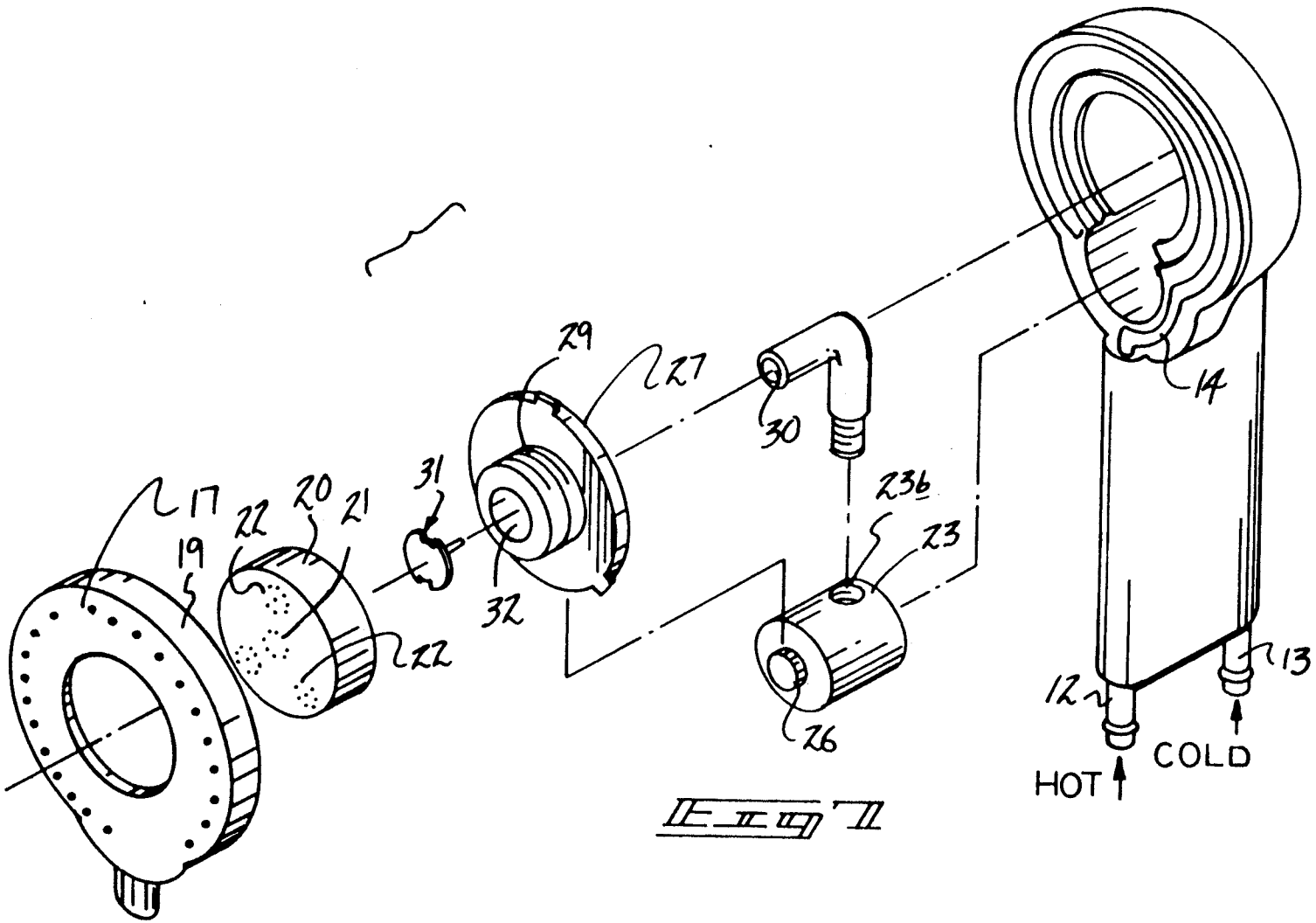
FIG. 11 is an orthographic view, taken along the lines 11—11 of FIG. 10 in the direction indicated by the arrows.
Figure 8:
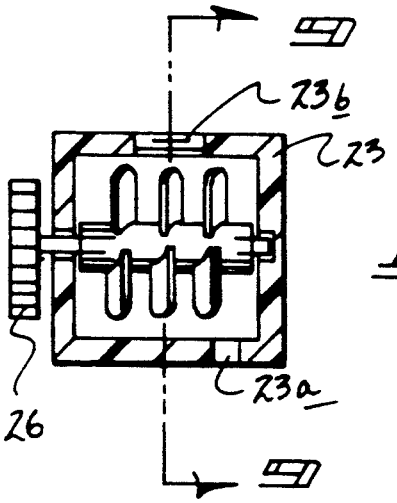
FIG. 8 is an orthographic cross-sectional illustration of the impeller housing utilized by the instant invention.
Figure 9:
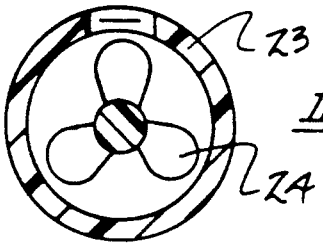
FIG. 9 is an orthographic view, taken along the lines 9—9 of FIG. 8 in the direction indicated by the arrows.
Figure 11:
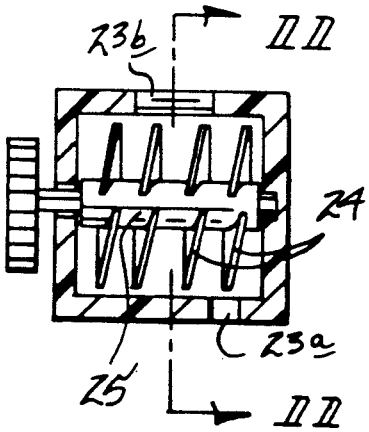
Figure 11:
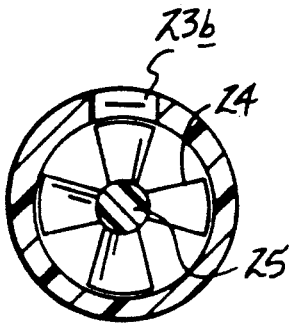

A second conduit impeller housing 23 is in fluid communication with the second conduit 13 within the head 15 to receive the unheated water therethrough and receive the water through an entrance opening 23*a* and direct the water outwardly thereof through an exit opening 23*b*. An impeller shaft 25 is rotatably mounted coaxially of the housing 23 and includes a series of stacked impeller blades 24 arranged coextensively and coaxially of the housing 23, wherein fluid from the second conduit 13 directed through the housing 23 effects rotation of the impeller shaft 25 and ultimately a driven gear 27 that projects coaxially and exteriorly through an upper end of the housing 23. Water directed through the impeller housing exit opening 23*b* is directed therefrom through a central conduit 30 and through a deflector hub 31 that includes a conical support stem that is mounted within a central opening conical outlet seat 32 of the central conduit 30. Water directed therethrough effects rotation of a deflector plate 34 mounted orthogonally to an upper terminal end of the conical support stem 33. The deflector plate 34 is of an eccentrically weighted configuration and includes at least one radial recess 35 directed through a peripheral edge of the deflector plate 34. As illustrated in FIGS. 4, 5, and 6, modified plates 34*a* and 34*b* may be utilized utilizing a plurality of radially recesses 35 to determine water to be directed about the deflector plate 34 and in fluid communication with the axial openings 21 to effect pulsing of water therethrough to the axial openings 21 and the outer opening groups 22. The eccentrically weighted deflector plate 34 will selectively baffle water directed to the plurality of outer opening groups 22 through an outer opening group conduit in fluid communication with the central conduit 30, as illustrated in FIG. 3.

The output drive gear 26 is in operative communication with a driven gear 27 that is mounted about a rotary hub 28 (see FIG. 3 for example) that in turn includes a rotary hub outer thread 28*a* that threadedly mounts the central cap housing 20 that includes a central cap inner threads 29. In this manner, rotation of the central cap housing 20, as well as the eccentrically weighted deflector hub 31 effects pulsing of water through the axial openings 21 and the outer opening groups 22.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shower head apparatus, comprising, a rigid conduit wand, the rigid conduit wand includes a respective first fluid conduit directing heated water therethrough, with a second fluid conduit spaced from the first fluid conduit directing unheated water therethrough, and a spray head fixedly mounted to the rigid conduit wand, including a spray head face orthogonally oriented relative to the rigid wand, and the head includes an annular array of first outlet ports directed about a peripheral portion of the spray head directed through the planar face in fluid communication with the first fluid conduit, and the second fluid conduit in fluid communication with a plurality of axial openings coaxially oriented relative to the planar face, and the second fluid conduit in fluid communication with a plurality of outer opening groups oriented interiorly of the first outlet ports and coaxially of the first outlet ports in an annular array about the axial openings, with pulsing means to effect pulsing of water through the axial openings and the outer opening groups, and the axial openings and the outer opening groups are mounted within a central cap housing, the central cap housing is rotatably mounted within the spray head.

2. An apparatus as set forth in claim 1 including an impeller housing mounted within the spray head, the impeller housing including an entrance opening directed through the impeller housing and an exit opening directed through the housing, with the housing including a housing cavity including an impeller shaft rotatably mounted within the housing coaxially of the housing, the impeller shaft including plural annular arrays of impeller blades directed coextensively about the shaft within the impeller housing, the impeller shaft directed coaxially and exteriorly of the impeller housing, with the impeller shaft including an output drive gear mounted to an outer terminal end of the impeller shaft exteriorly of the impeller housing, and a driven gear cooperating with the drive gear, the driven gear fixedly mounted about a rotary hub, the rotary hub fixedly secured to the central cap housing to effect rotation of the central cap housing upon rotation of the drive gear.

3. An apparatus as set forth in claim 2 wherein the impeller housing exit opening includes a central conduit, the central conduit directed through the spray head from the impeller housing terminating in a conical outlet seat coaxially oriented relative to the spray head and directed coaxially of the rotary hub and the central cap housing, wherein the conical outlet seat is coaxially aligned relative to the rotary hub, the pulsing means includes, a conical support stem rotatably mounted within the conical outlet seat, and an eccentrically weighted deflector plate mounted orthogonally to an upper terminal end of the conical support stem, the deflector plate including at least one radial recess directed through a peripheral edge of the deflector plate, and the axial openings and the plurality of outer openings are in fluid communication with the central conduit through the radial recess to selectively and intermittedly direct the water through the at least one radial recess into the axial openings and the outer opening groups.

* * * * *